US010426257B2

(12) United States Patent
Hu et al.

(10) Patent No.: US 10,426,257 B2
(45) Date of Patent: Oct. 1, 2019

(54) AUTOMATIC HANDLE ASSEMBLY SYSTEM FOR PAINT BRUSH

(71) Applicant: JIANGSU NORMAL UNIVERSITY, Jiangsu (CN)

(72) Inventors: Ningning Hu, Jiangsu (CN); Ping Zhou, Jiangsu (CN); Zhenzhi He, Jiangsu (CN); Gongbo Zhou, Jiangsu (CN); Chaoquan Tang, Jiangsu (CN); Jinhe Wu, Jiangsu (CN); Xiang Zhang, Jiangsu (CN)

(73) Assignee: Jiangsu Normal University, Xuzhou, Jiangsu (CN)

( * ) Notice: Subject to any disclaimer, the term of this patent is extended or adjusted under 35 U.S.C. 154(b) by 0 days.

(21) Appl. No.: 16/091,109

(22) PCT Filed: Dec. 7, 2016

(86) PCT No.: PCT/CN2016/108783
§ 371 (c)(1),
(2) Date: Oct. 4, 2018

(87) PCT Pub. No.: WO2018/058782
PCT Pub. Date: Apr. 5, 2018

(65) Prior Publication Data

US 2019/0150605 A1 May 23, 2019

(30) Foreign Application Priority Data

Sep. 30, 2016 (CN) ..... 2016 1 0879430

(51) Int. Cl.
*A46D 3/08* (2006.01)
*A46D 3/04* (2006.01)

(52) U.S. Cl.
CPC ..... *A46D 3/087* (2013.01); *A46D 3/045* (2013.01); *A46D 3/08* (2013.01); *A46D 3/085* (2013.01)

(58) Field of Classification Search
CPC ..... A46D 3/04; A46D 3/045; A46D 3/047; A46D 3/08; A46D 3/087; A46D 3/085
(Continued)

(56) References Cited

U.S. PATENT DOCUMENTS 2,513,016 A 6/1950 First
3,747,983 A 7/1973 Hodgson

FOREIGN PATENT DOCUMENTS

CN 105661885 6/2016
CN 105708128 6/2016
(Continued)

OTHER PUBLICATIONS

"International Search Report (Form PCT/ISA/210)", dated Jun. 19, 2017, with English translation thereof, pp. 1-4.

*Primary Examiner* — Laura C Guidotti
(74) *Attorney, Agent, or Firm* — JCIPRNET

(57) ABSTRACT

An automatic handle assembly system for a paint brush, including a feeding device, a conveying device, a handle pushing device, a pneumatic system, and a control system. The feeding device is used for transporting a glue-filled paint brush head to an entrance of the conveying device. The conveying device is used for realizing transportation, pressing and precise positioning of the paint brush head. The handle pushing device is used for pushing a paint brush handle to precisely insert into the paint brush head. The feeding device, the conveying device, and the handle pushing device are all connected to the pneumatic system and the control system.

7 Claims, 11 Drawing Sheets

(58) Field of Classification Search
USPC ..... 300/2, 10, 11, 20, 21
See application file for complete search history.

(56) References Cited

FOREIGN PATENT DOCUMENTS

| | | |
|---|---|---|
| CN | 105901900 | 8/2016 |
| WO | 2013175382 | 11/2013 |

23
24
25
202
222
202-5
202-4
202-3
202-2
202-1
202-6
202-7
202-8
202-9
202-10
202-11
202-12
202-13
202-14
202-15
202-16
202-17
202-18
202-19
202-20
202-21
202-22
202-23
202-24
202-25
202-26
202-27
202-28
202-29
202-30
202-31
202-32
202-33
202-34
202-35
202-36
202-37
202-38
202-39
202-40
202-41
202-42
202-43
202-44
202-45

15
11
231
301
253
501
502
503
505
506
507
508
509
510
511
512
513
514
515
516
517
518
519
520
521
522
523
524
525
526
527
528
529
530
531
532
533
534
535
536
537
538
539
540
541
542
543
544

AUTOMATIC HANDLE ASSEMBLY SYSTEM FOR PAINT BRUSH

CROSS-REFERENCE TO RELATED APPLICATION

This is a 371 application of the International PCT application serial no. PCT/CN2016/108783, filed on Dec. 7, 2016, which claims the priority benefits of China Application No. 201610879430.4, filed on Sep. 30, 2016. The entirety of each of the above-mentioned patent applications is hereby incorporated by reference herein and made a part of this specification.

TECHNICAL FIELD

The present invention relates to an automatic handle assembly system for a paint brush, which belongs to a technical field of brush manufacturing equipment.

BACKGROUND

In a production process procedure of paint brushes in the brush manufacturing industry, it is an indispensable step to assemble a handle on a paint brush head, that is, to push a handle into a glue-filled brush head. Currently, machinery in national brush manufacturing industry still needs to be developed and improved. Most of the brush manufacturing machines are designed and manufactured by respective enterprises at different technological levels, and many steps require entire manual operations.

Particularly, a handle assembly step greatly depends on manual work, and has low production efficiency and a low level of automation, which results in a serious problem. Therefore, a design of an automatic handle assembly system suitable for application in many types of paint brush handles has certain practical significance for the improvement of production efficiency of paint brushes, improvement of product quality, and reduction of production costs, and the like.

SUMMARY OF THE INVENTION

Inventive objective: To overcome the deficiencies that exist in the prior art. The present invention provides an automatic handle assembly system for a paint brush, which is suitable for many types of paint brush handles, has a high level of automation and convenience in operation, and can improve production efficiency and product quality of paint brushes, and effectively reduce production costs.

Technical solution: To achieve the foregoing objective, a technical solution adopted in the present invention is as follows:

An automatic handle assembly system for a paint brush includes a feeding device, a conveying device, and a handle pushing device. The feeding device is disposed on a right side of the conveying device. The handle pushing device is disposed on a rear side of the conveying device. The feeding device is used for transporting a glue-filled paint brush head to an entrance of the conveying device. The conveying device is used for realizing transportation, pressing and precise positioning of the paint brush head. The handle pushing device is used for pushing a paint brush handle to precisely insert into the paint brush head, and completing the assembly of the paint brush handle.

Preferably, the feeding device includes a base, a mounting plate, a guiding mechanism, a transversely-moving cylinder, an elevation cylinder, an electromagnetic chuck, and a threaded connecting piece. The mounting plate is horizontally fixed on the base. The transversely-moving cylinder is disposed at the mounting plate. The guiding mechanism includes a first gantry, a second gantry, a guiding rod, a linear bearing, and a connecting piece, wherein the first gantry and the second gantry are fixed on the mounting plate. The guiding rod is horizontally fixed on the first gantry and the second gantry. One end of the guiding rod passes through the first gantry to extend onto the second gantry, and the other end of the guiding rod extends above the entrance of the conveying device. The linear bearing is sleeved on the guiding rod. The connecting piece and the linear bearing are integrally connected as one piece. The elevation cylinder is fixed at a bottom of the connecting piece. A piston rod of the transversely-moving cylinder is connected to the connecting piece. The electromagnetic chuck is disposed on a piston rod of the elevation cylinder through the threaded connecting piece.

After the electromagnetic chuck attracts a brush head with an iron shell, it may be elevated under the effect of the elevation cylinder. The elevation cylinder may move transversely under the effect of the transversely-moving cylinder, so as to transport the glue-filled paint brush head to the entrance of the conveying device.

Preferably, the conveying device includes a machine frame, a conveying platform, a brush head guiding mechanism, a brush head pre-pressing mechanism, a pressing-positioning mechanism, and a linkage transport mechanism. The conveying platform is strip-shaped and is horizontally fixed on the machine frame. A right end of the conveying platform is the entrance. The linkage transport mechanism is disposed below the conveying platform. The brush head guiding mechanism, the brush head pre-pressing mechanism, and the pressing-positioning mechanism are sequentially disposed from right to left on the conveying platform. A handle assembly station is located at the pressing-positioning mechanism on the conveying platform. The linkage transport mechanism includes a transmission mechanism, two plane linkage mechanisms, a pushing claw, and a pushing claw mounting rod. The transmission mechanism includes a rotary motor, a coupling member, a belt pulley, and a supporting platform. The rotary motor and the belt pulley are disposed on the supporting platform. The belt pulley includes a driving shaft, a driving wheel, a driven shaft, a driven wheel, a conveyor belt, and an adjustment bolt. The driving wheel, the driven wheel, and the adjustment bolt are used to tension the conveyor belt. The rotary motor drives the driving shaft and the driving wheel to rotate via the coupling member, and further drives the driven wheel and the driven shaft to rotate via the conveyor belt. The two plane linkage mechanisms are consistent in shape and size. The two plane linkage mechanisms include a first linkage mechanism and a second linkage mechanism. The first linkage mechanism includes a first crank, a first linkage, a first rocker, a first supporting rod, and a first fixing rod. The second linkage mechanism includes a second crank, a second linkage, a second rocker, a second supporting rod, and a second fixing rod. A head end of the first crank is hinged to the driving shaft, and the first crank and the driving shaft rotate synchronously. A tail end of the first crank is hinged to a head end of the first linkage. A tail end of the first linkage is hinged to a head end of the first rocker. A tail end of the first rocker is hinged to a free end of the first fixing rod. A head end of the second crank is hinged to the driven shaft, and the second crank and the driven shaft rotate synchronously. The second crank and the first crank are consistent in initial position. Connection relationship among the second crank, the second linkage, the second rocker, and the second fixing rod are consistent with connection relationship among the first crank, the first linkage, the first rocker, and the first fixing rod. The first fixing rod and the second fixing rod are both vertically fixed at a bottom of the conveying platform. Lower ends of the first supporting rod and the second supporting rod are respectively hinged to a middle of the first linkage and the middle of the second linkage. The pushing claw mounting rod is horizontally disposed at upper ends of the first supporting rod and the second supporting rod. Recesses with equal intervals are provided on the pushing claw mounting rod. The pushing claw is mounted in the recesses. The conveying platform is provided in a length direction with a long groove for the pushing claw to pass therethrough.

The pushing claw is used for pushing a brush head from the brush head guiding mechanism towards the brush head pre-pressing mechanism and the pressing-positioning mechanism, and pushing a paint brush that has inserted with a handle to a next step.

The brush head guiding mechanism includes a first guiding plate and a second guiding plate. The first guiding plate and the second guiding plate are disposed opposite to each other on a front lateral edge and a rear lateral edge of the conveying platform. A distance between the first guiding plate and the second guiding plate is adjustable.

The brush head guiding mechanism may guide a brush head to prevent the brush head from deviating during transportation, so as to prevent the quality of handle assembly from being affected. The distance between the second guiding plate and the first guiding plate can be adjusted to adapt to different types of brush heads.

The brush head pre-pressing mechanism includes a first mounting frame, an upper pressing plate, a lower pressing plate, and a first spring component. The first mounting frame is disposed on the front lateral edge of the conveying platform. The upper pressing plate is horizontally fixed on the first mounting frame, and the lower pressing plate is disposed below the upper pressing plate through the first spring component.

When a brush head enters the brush head pre-pressing mechanism, the brush head enables the lower pressing plate to move upward. At this time, a spring is compressed to produce a particular pressing force, so as to restrict the brush head from deviating during movement, thereby improving precision of conveyance.

The pressing-positioning mechanism includes a second mounting frame, a pressing cylinder, an upper plate, a lower plate, and a second spring component. The second mounting frame is disposed on the front lateral edge of the conveying platform. The upper plate is horizontally fixed on the second mounting frame, and the lower plate is disposed below the upper plate through the second spring component. The pressing cylinder is fixed on the second mounting frame, and a compressing block is disposed on a piston rod of the pressing cylinder. An opening for the compressing block to pass therethrough is provided on the upper plate, and the compressing block is used to press down the lower plate.

When starting to assemble a handle, the pressing cylinder is pressed down to enable the lower plate to tightly press a brush head, so as to keep the brush head from moving when the handle enters.

Preferably, the handle pushing device includes a bracket, a mounting platform, a handle pushing mechanism, a handle storage mechanism, a handle pressing mechanism, and a shell supporting mechanism. The mounting platform is horizontally fixed on the bracket. A handle assembly port is provided at a front end of the mounting platform, and is joined to a discharge port of the conveying device. The handle pushing mechanism, the handle storage mechanism, and the shell supporting mechanism are sequentially disposed from rear to front on the mounting platform. The handle pressing mechanism is disposed on the handle storage mechanism. The handle pushing mechanism includes a handle pushing cylinder, an L-shaped connecting plate, a first pushing rod, a second pushing rod, a guide rail, and a sliding seat. The handle pushing cylinder and the guide rail are both disposed on the mounting platform. The sliding seat corresponds to the guide rail. The L-shaped connecting plate is fixed on the sliding seat, and the L-shaped connecting plate is connected to a piston rod of the handle pushing cylinder. The first pushing rod and the second pushing rod are detachably mounted on the L-shaped connecting plate, and front ends of the first pushing rod and the second pushing rod are arc-shaped to fit a handle.

The first pushing rod and the second pushing rod push the handle in the handle storage mechanism into a brush head of the pressing-positioning mechanism under a pushing force of the handle pushing cylinder.

The handle storage mechanism includes a mounting frame, a cross rod, a left material storage tank, a right material storage tank, and a rear material storage tank. The mounting frame is fixed on the mounting platform. The rear material storage tank is detachably disposed on the mounting platform. Sliding blocks are fixedly connected to both the left material storage tank and the right material storage tank. The sliding blocks at lower ends of the left material storage tank and the right material storage tank are sleeved on the mounting frame. The cross rod passes through the sliding blocks in the middle of the left material storage tank and the right material storage tank.

A gap between the left material storage tank and the right material storage tank and the position of the rear material storage tank may be adjusted to adapt to storage of different types of handles.

The handle pressing mechanism includes a connecting beam, a telescopic guiding rod, a pressing block, and a tapered rod. One end of the connecting beam is fixed in the middle of the mounting frame. The pressing block is disposed at a bottom of the other end of the connecting beam through the telescopic guiding rod and the tapered rod. A reset spring is sleeved on the telescopic guiding rod.

The handle pressing mechanism can ensure a fine contact between the handle and the mounting platform. The reset spring has auxiliary pressing and resetting effects. The tapered rod may ensure that the pressing block does not separate under the effect of gravity.

The shell supporting mechanism includes a shell supporting cylinder, a U-shaped connecting frame, an upper spring sheet, and a lower spring sheet. The shell supporting cylinder is disposed on the mounting platform. An opening of the U-shaped connecting frame faces rightward, and a middle thereof is connected to a piston rod of the shell supporting cylinder. The upper spring sheet and the lower spring sheet are respectively fixed on an upper lateral edge and a lower lateral edge of the U-shaped connecting frame. An angle is formed between free ends of the upper spring sheet and the lower spring sheet, and a top end of the angle is aligned with a handle assembly station.

The shell supporting mechanism may guide the handle and support an opening of the iron shell of the brush head before the handle is inserted in the brush head.

Preferably, a pneumatic system is further included. The feeding device, the conveying device, and the handle pushing device are all connected to the pneumatic system. The pneumatic system includes an air compressor, a check valve, a gas storage tank, a secondary pressure-regulation loop, a two-position three-way solenoid valve, a two-position five-way solenoid directional valve, and an adjustable one-way throttle valve. The air compressor, the check valve, the gas storage tank, and the secondary pressure-regulation loop are sequentially connected to form a main gas path. A pressure relay, a pressure reduction valve, and a pressure gauge are disposed on the gas storage tank. A gas outlet of the secondary pressure-regulation loop is connected to five branches, and the five branches are respectively connected to the elevation cylinder, the transversely-moving cylinder, the handle pushing cylinder, the shell supporting cylinder, and the pressing cylinder. The elevation cylinder, the transversely-moving cylinder, and the handle pushing cylinder are respectively connected to the secondary pressure-regulation loop through the two-position five-way solenoid directional valve and the adjustable one-way throttle valve. The shell supporting cylinder and the pressing cylinder are respectively connected to the secondary pressure-regulation loop through the two-position three-way solenoid valve and the adjustable one-way throttle valve.

The working principle of the pneumatic system is as follows: First, the air compressor is used to generate a pressure, and an electrical signal of the pressure relay is used to control the air compressor to keep the pressure constant in the gas storage tank; then, the output air pressure is kept within a set range via the secondary pressure-regulation loop; the solenoid valve is used to introduce gas into the cylinders, and the adjustable one-way throttle valve is used to adjust the operation speeds of the cylinders.

Preferably, a control system is further included. The feeding device, the conveying device, the handle pushing device, and the pneumatic system are all connected to the control system. The control system includes a controller, a ULN2003 chip (the chip has an opto-coupling function, and may be directly connected to an output port of a single-chip microcomputer), and a stepper motor driver. The controller uses an AT89S52 single-chip microcomputer. Magnetic switches are disposed on the elevation cylinder, the transversely-moving cylinder, and the handle pushing cylinder. A position switch is disposed at the handle assembly station on the conveying platform. The magnetic switches and the position switch are connected to a signal input terminal of the AT89S52 single-chip microcomputer. A signal output terminal of the AT89S52 single-chip microcomputer is connected to the two-position five-way solenoid directional valve, the two-position three-way solenoid valve, and the electromagnetic chuck through the ULN2003 chip, and the signal output terminal of the AT89S52 single-chip microcomputer is connected to the rotary motor through the stepper motor driver.

The working principle of the control system is as follows: When pressing a start or stop switch, the system starts or stops working. During operation, the magnetic switches on the elevation cylinder, the transversely-moving cylinder, and the handle pushing cylinder detects whether the cylinders move to desired positions, the position switch at the handle assembly station detects whether a brush head moves to a desired position, and the magnetic switches and the position switch transfer detection results to a signal input terminal of the controller. The controller outputs an operation instruction according to a set program after receiving the detection signals. Control signals output by the controller are amplified by the ULN2003 chip, and the amplified control signals are then transferred to the two-position three-way solenoid valve, the two-position five-way solenoid directional valve, and the electromagnetic chuck. By controlling gains and losses of the two-position three-way solenoid valve, the two-position five-way solenoid directional valve, and the electromagnetic chuck, corresponding cylinders are controlled to complete movement. In addition, the controller uses the stepper motor driver to control rotational speed of the rotary motor.

Preferably, a gap between the first pushing rod and the second pushing rod is adjustable, so as to adapt to different types of brush handles.

Preferably, a groove matching a shape of the brush head is disposed at a bottom of the lower plate, and the lower plate is pressed down to keep the brush head in the groove, thereby improving the precision of handle assembly. A notch is provided at the handle assembly station on the conveying platform, thereby preventing interference with spring sheets of the shell supporting mechanism.

Beneficial effects: In comparison with the prior art, the automatic handle assembly system for a paint brush provided in the present invention has the following advantages. (1) The present invention has a compact structure, simple operations, efficient production, safety and reliability, and can replace human labor to achieve automatic handle assembly of paint brushes. (2) Related components can be adjusted to adapt for many types of paint brush handles, thereby saving the costs. (3) The present invention has a high level of automation and precision in assembly and positioning, thereby improving the production efficiency and product quality of the paint brushes, and effectively reducing production costs.

Figure 1:
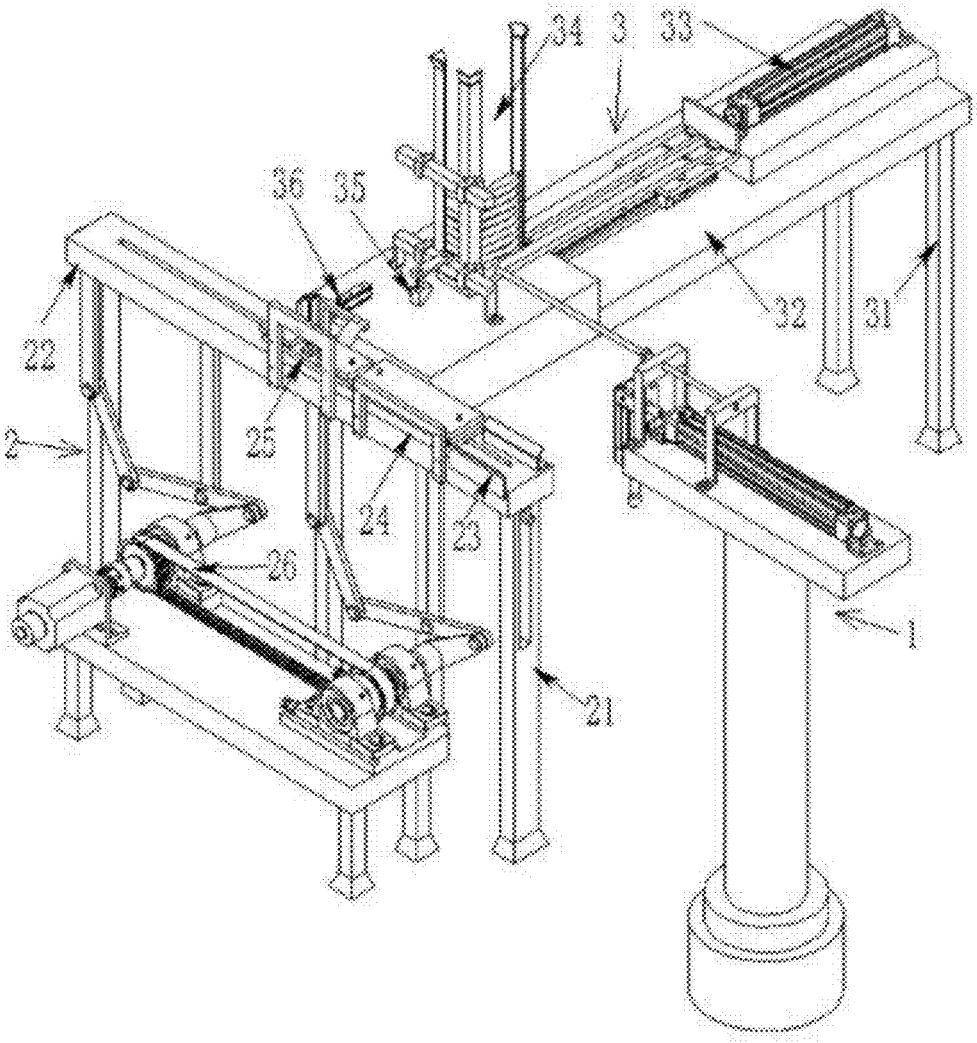
FIG. 1 is an overall schematic structural diagram according to the present invention.

In the drawings: 1, feeding device, 11, base, 12, mounting plate, 13, guiding mechanism, 14, transversely-moving cylinder, 15, elevation cylinder, 16, electromagnetic chuck, 17, threaded connecting piece, 131, first gantry, 132, second gantry, 133, guiding rod, 134, linear bearing, and 135, connecting piece;

2, conveying device, 21, machine frame, 22, conveying platform, 23, brush head guiding mechanism, 24, brush head pre-pressing mechanism, 25, pressing-positioning mechanism, 26, linkage transport mechanism, 261, transmission mechanism, 262, first linkage mechanism, 263, pushing claw, 264, pushing claw mounting rod, 261-1, rotary motor, 261-2, coupling member, 261-3, driving shaft, 261-4, driving wheel, 261-5, conveyor belt, 261-6, driven shaft, 261-7, driven wheel, 261-8, adjustment bolt, 261-9, supporting platform, 262-1, first crank, 262-2, first linkage, 262-3, first rocker, 262-4, first supporting rod, 262-5, first fixing rod, 221, long groove, 222, notch, 231, first guiding plate, 232, second guiding plate, 241, first mounting frame, 242, upper pressing plate, 243, lower pressing plate, 244, first spring component, 251, second mounting frame, 252, pressing cylinder, 253, upper plate, 254, lower plate, 255, second spring component, and 256, compressing block;

3, handle pushing device, 31, bracket, 32, mounting platform, 33, handle pushing mechanism, 34, handle storage mechanism, 35, handle pressing mechanism, 36, shell supporting mechanism, 331, handle pushing cylinder, 332, L-shaped connecting plate, 333, first pushing rod, 334, second pushing rod, 335, sliding seat, 336, guide rail, 341, mounting frame, 342, sliding block, 343, cross rod, 344, left material storage tank, 345, right material storage tank, 346, rear material storage tank, 351, connecting beam, 352, telescopic guiding rod, 353, tapered rod, 354, pressing block, 361, shell supporting cylinder, 362, U-shaped connecting frame, 363, lower spring sheet, 364, and upper spring sheet; and

41, air compressor, 42, check valve, 43, gas storage tank, 44, secondary pressure-regulation loop, 45, two-position three-way solenoid valve, 46, two-position five-way solenoid directional valve, and 47, adjustable one-way throttle valve.

DETAILED DESCRIPTION OF EMBODIMENTS

The present invention is further described below with reference to the accompanying drawings and embodiments.

As shown in FIG. 1, which shows an automatic handle assembly system for a paint brush, including a feeding device 1, a conveying device 2, and a handle pushing device 3. The feeding device 1 is disposed on a right side of the conveying device 2. The handle pushing device 3 is disposed on a rear side of the conveying device 2. The feeding device 1 is used for transporting a glue-filled paint brush head to an entrance of the conveying device 2.

The conveying device 2 is used for realizing transportation, pressing and precise positioning of the paint brush head.

The handle pushing device 3 is used for pushing a paint brush handle to precisely insert into the paint brush head, and completing the assembly of the paint brush handle.

Figure 2:
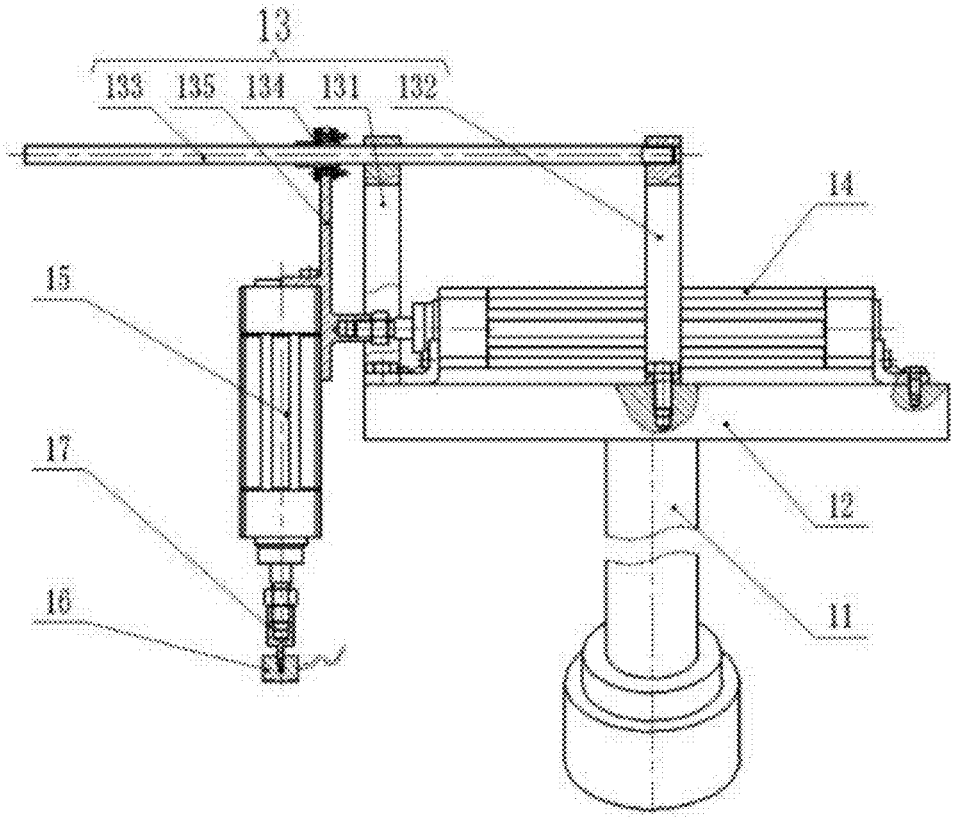
FIG. 2 is a main view of a feeding device according to the present invention.

In this embodiment, as shown in FIG. 2, the feeding device 1 includes a base 11, a mounting plate 12, a guiding mechanism 13, a transversely-moving cylinder 14, an elevation cylinder 15, an electromagnetic chuck 16, and a threaded connecting piece 17.

The mounting plate 12 is horizontally fixed on the base 11. The transversely-moving cylinder 14 is disposed at the mounting plate 12. The guiding mechanism 13 includes a first gantry 131, a second gantry 132, a guiding rod 133, a linear bearing 134, and a connecting piece 135. The first gantry 131 and the second gantry 132 are fixed on the mounting plate 12. The guiding rod 133 is horizontally fixed on the first gantry 131 and the second gantry 132. One end of the guiding rod 133 passes through the first gantry 131 to extend onto the second gantry 132, and the other end of the guiding rod 133 extends above the entrance of the conveying device 2. The linear bearing 134 is sleeved on the guiding rod 133. The connecting piece 135 and the linear bearing 134 are integrally connected as one piece. The elevation cylinder 15 is fixed at a bottom of the connecting piece 135, and a piston rod of the transversely-moving cylinder 14 is connected to the connecting piece 135. The electromagnetic chuck 16 is disposed on a piston rod of the elevation cylinder 15 through the threaded connecting piece 17.

In this embodiment, the conveying device 2 includes a machine frame 21, a conveying platform 22, a brush head guiding mechanism 23, a brush head pre-pressing mechanism 24, a pressing-positioning mechanism 25, and a linkage transport mechanism 26.

The conveying platform 22 is strip-shaped and is horizontally fixed on the machine frame 21, and a right end of the conveying platform 22 is the entrance. The linkage transport mechanism 26 is disposed below the conveying platform 22. The brush head guiding mechanism 23, the brush head pre-pressing mechanism 24, and the pressing-positioning mechanism 25 are sequentially disposed from right to left on the conveying platform 22. A handle assembly station is located at the pressing-positioning mechanism 25 on the conveying platform 22.

Figure 3:
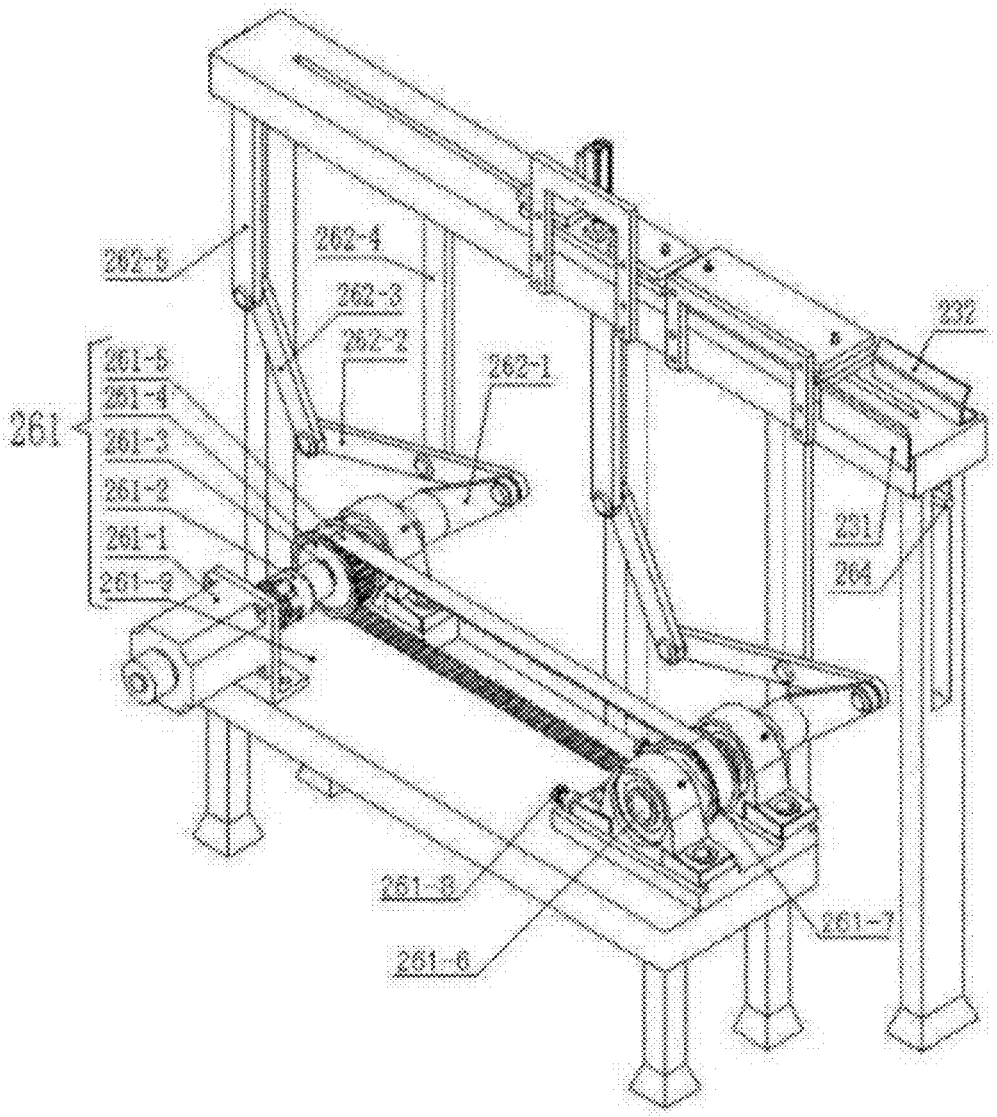
FIG. 3 is a schematic structural diagram of a conveying device according to the present invention.
Figure 4:
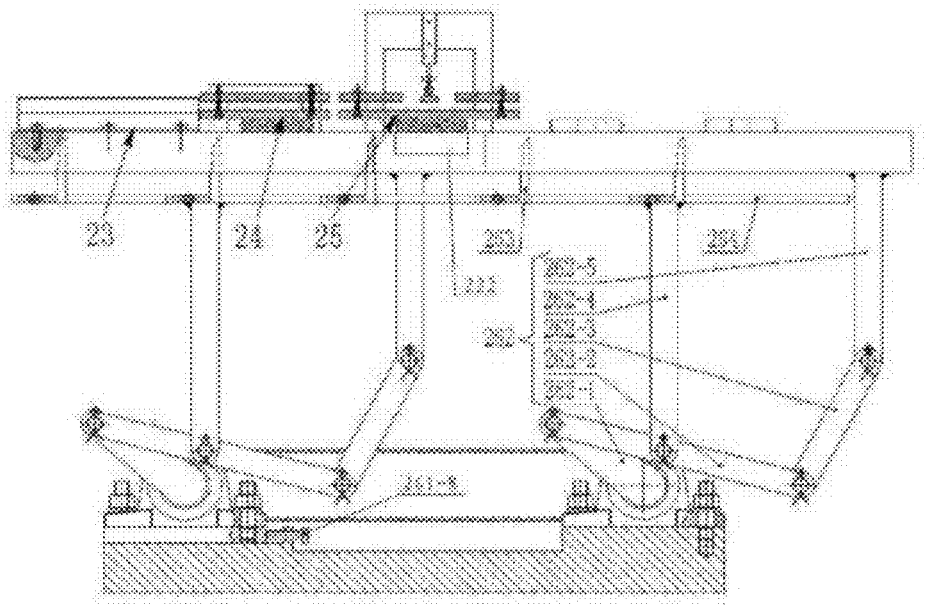
FIG. 4 is a rear view of a conveying device according to the present invention.

As shown in FIG. 3 and FIG. 4, the linkage transport mechanism 26 includes a transmission mechanism 261, two plane linkage mechanisms, a pushing claw 263, and a pushing claw mounting rod 264, the transmission mechanism 261 includes a rotary motor 261-1, a coupling member 261-2, a belt pulley, and a supporting platform 261-9. The rotary motor 261-1 and the belt pulley are disposed on the supporting platform 261-9. The belt pulley includes a driving shaft 261-3, a driving wheel 261-4, a driven shaft 261-6, a driven wheel 261-7, a conveyor belt 261-5, and an adjustment bolt 261-8. The driving wheel 261-4, the driven wheel 261-7, and the adjustment bolt 261-8 are used to tension the conveyor belt 261-5. The rotary motor 261-1 drives the driving shaft 261-3 and the driving wheel 261-4 to rotate via the coupling member 261-2, and further drives the driven wheel 261-7 and the driven shaft 261-6 to rotate via the conveyor belt 261-5.

The two plane linkage mechanisms are consistent in shape and size. The two plane linkage mechanisms include a first linkage mechanism 262 and a second linkage mechanism, the first linkage mechanism 262 includes a first crank 262-1, a first linkage 262-2, a first rocker 262-3, a first supporting rod 262-4, and a first fixing rod 262-5. The second linkage mechanism includes a second crank, a second linkage, a second rocker, a second supporting rod, and a second fixing rod.

A head end of the first crank 262-1 is hinged to the driving shaft 261-3, and the first crank 262-1 and the driving shaft 261-3 rotate synchronously. A tail end of the first crank 262-1 is hinged to a head end of the first linkage 262-2. A tail end of the first linkage 262-2 is hinged to a head end of the first rocker 262-3. A tail end of the first rocker 262-3 is hinged to a free end of the first fixing rod 262-5. A head end of the second crank is hinged to the driven shaft 261-6, and the second crank and the driven shaft 261-6 rotate synchronously. The second crank and the first crank 262-1 are consistent in initial position, and connection relationship among the second crank, the second linkage, the second rocker, and the second fixing rod are consistent with connection relationship among the first crank 262-1, the first linkage 262-2, the first rocker 262-3, and the first fixing rod 262-5. The first fixing rod 262-5 and the second fixing rod are both vertically fixed at a bottom of the conveying platform 22, and lower ends of the first supporting rod 262-4 and the second supporting rod are respectively hinged to a middle of the first linkage 262-2 and a middle of the second linkage.

Figure 5:
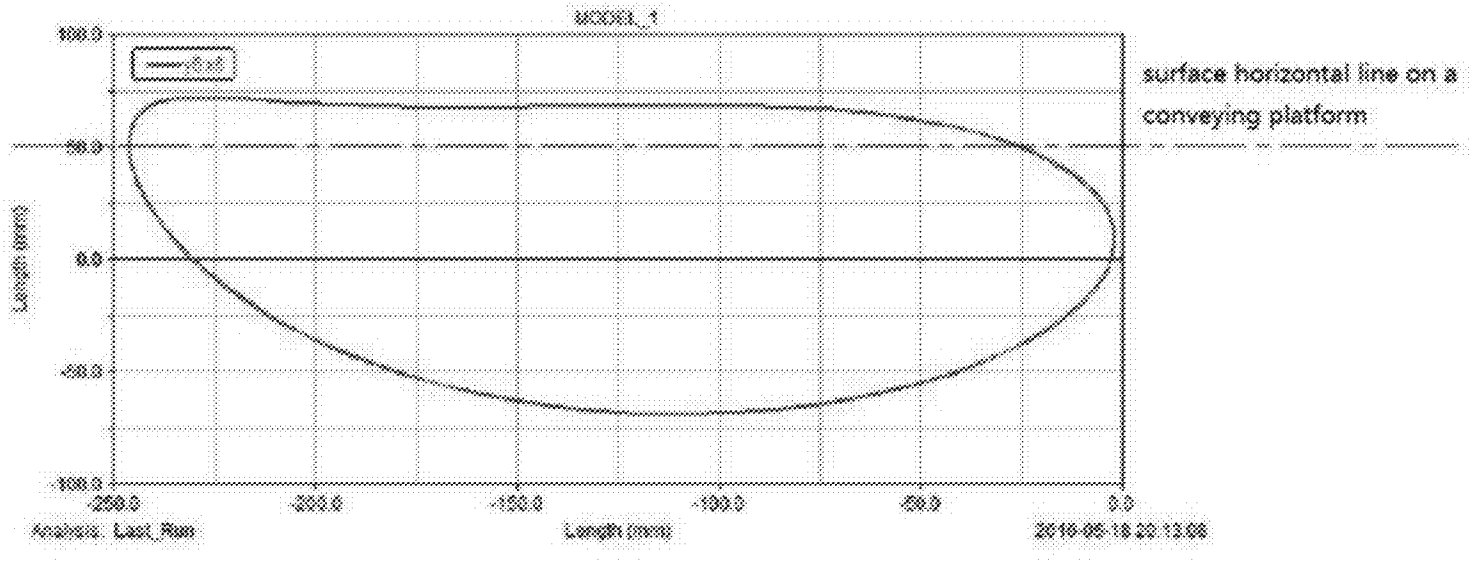
FIG. 5 is a view showing a movement trajectory of a pushing claw according to the present invention.

The pushing claw mounting rod 264 is horizontally disposed at upper ends of the first supporting rod 262-4 and the second supporting rod, recesses with equal intervals are provided on the pushing claw mounting rod 264. The pushing claw 263 is mounted in the recesses. FIG. 5 shows a movement trajectory of the pushing claw 263 under the effect of the linkage transport mechanism 26.

Figure 6:
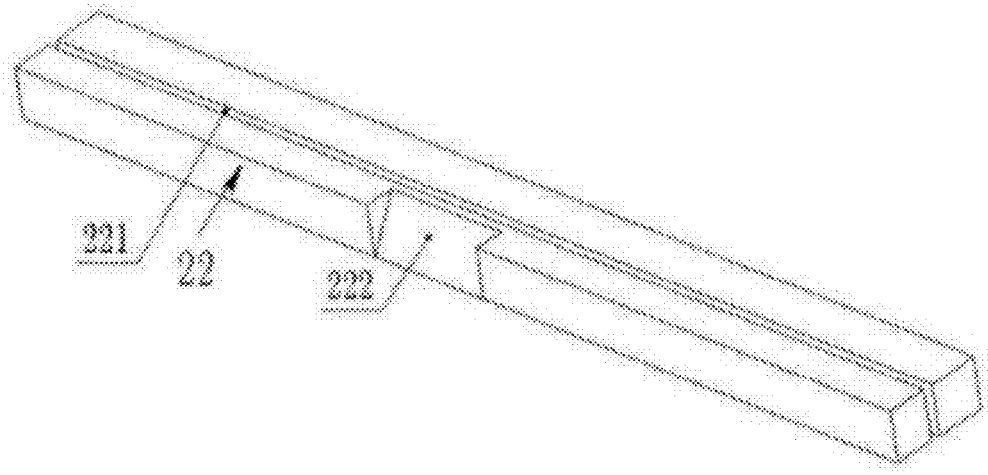
FIG. 6 is a schematic structural diagram of a conveying platform according to the present invention.

As shown in FIG. 6, the conveying platform 22 is provided in a length direction with a long groove 221 for the pushing claw 263 to pass therethrough. A notch 222 is provided at the handle assembly station on the conveying platform 22.

As shown in FIG. 3, the brush head guiding mechanism 23 includes a first guiding plate 231 and a second guiding plate 232. The first guiding plate 231 and the second guiding plate 232 are disposed opposite to each other on a front lateral edge and a rear lateral edge of the conveying platform 22. A distance between the first guiding plate 231 and the second guiding plate 232 is adjustable.

Figure 7:
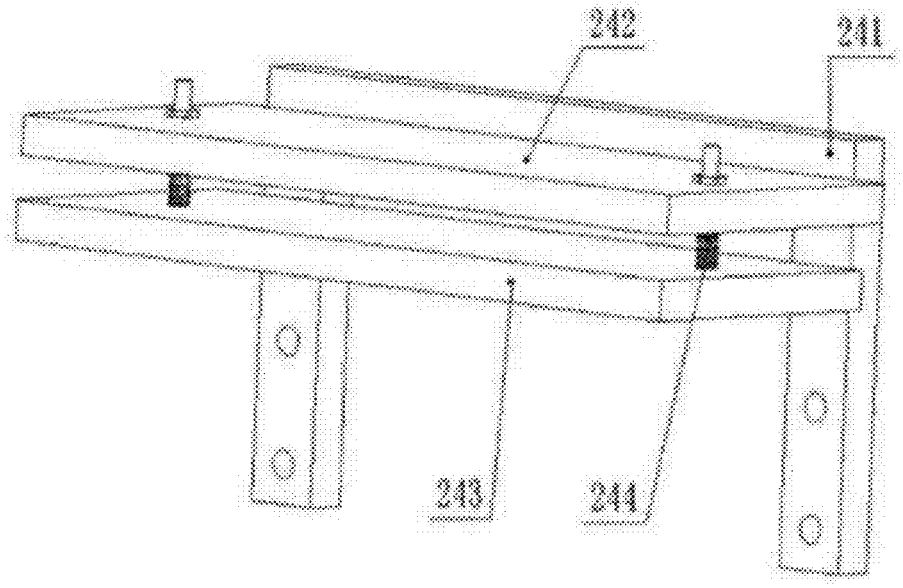
FIG. 7 is a schematic structural diagram of a brush head pre-pressing mechanism according to the present invention.

As shown in FIG. 7, the brush head pre-pressing mechanism 24 includes a first mounting frame 241, an upper pressing plate 242, a lower pressing plate 243, and a first spring component 244. The first mounting frame 241 is disposed on the front lateral edge of the conveying platform 22. The upper pressing plate 242 is horizontally fixed on the first mounting frame 241, and the lower pressing plate 243 is disposed below the upper pressing plate 242 through the first spring component 244.

Figure 8:
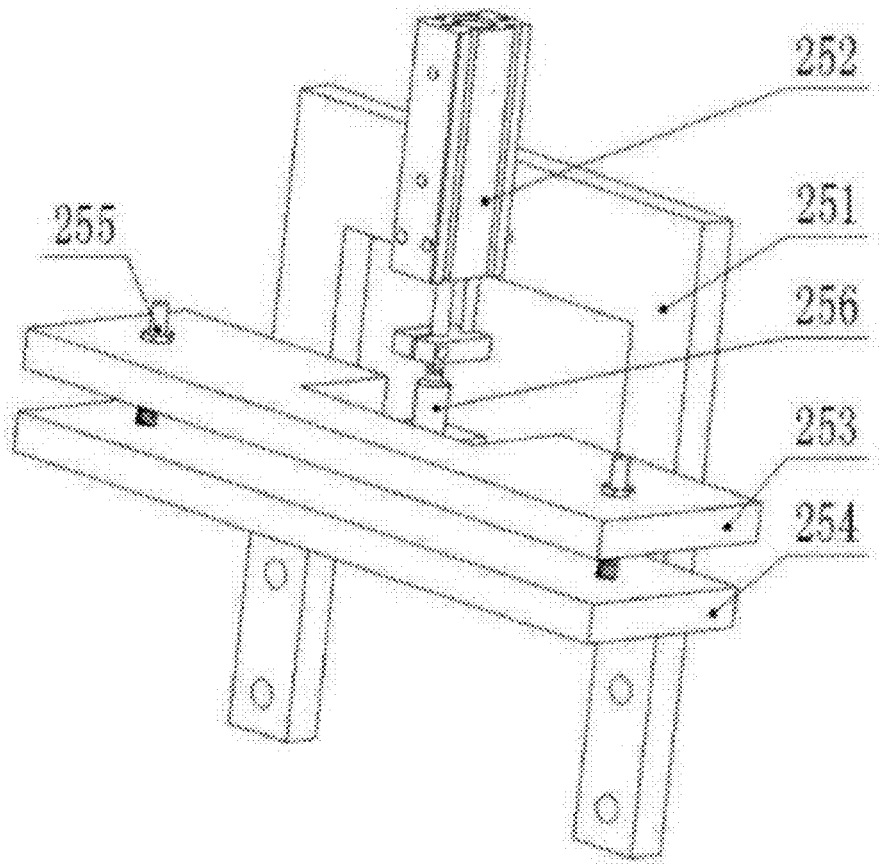
FIG. 8 is a schematic structural diagram of a pressing-positioning mechanism according to the present invention.

As shown in FIG. 8, the pressing-positioning mechanism 25 includes a second mounting frame 251, a pressing cylinder 252, an upper plate 253, a lower plate 254, and a second spring component 255. The second mounting frame 251 is disposed on the front lateral edge of the conveying platform 22. The upper plate 253 is horizontally fixed on the second mounting frame 251, and the lower plate 254 is disposed below the upper plate 253 through the second spring component 255. The pressing cylinder 252 is fixed on the second mounting frame 251, and a compressing block 256 is disposed on a piston rod of the pressing cylinder 252. An opening for the compressing block 256 to pass therethrough is provided on the upper plate 253, and the compressing block 256 is used to press down the lower plate 254. A groove matching a shape of a brush head is disposed at a bottom of the lower plate 254, and the lower plate 254 is pressed down to keep the brush head in the groove.

In this embodiment, the handle pushing device 3 includes a bracket 31, a mounting platform 32, a handle pushing mechanism 33, a handle storage mechanism 34, a handle pressing mechanism 35, and a shell supporting mechanism 36.

The mounting platform 32 is horizontally fixed on the bracket 31. The handle pushing mechanism 33, the handle storage mechanism 34, and the shell supporting mechanism 36 are sequentially disposed from rear to front on the mounting platform 32. The handle pressing mechanism 35 is disposed on the handle storage mechanism 34.

Figure 9:
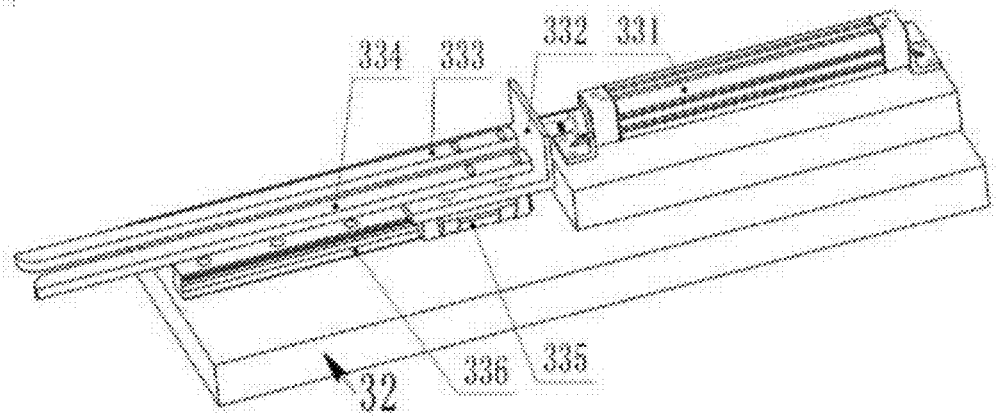
FIG. 9 is a schematic structural diagram of a handle pushing mechanism according to the present invention.

As shown in FIG. 9, the handle pushing mechanism 33 includes a handle pushing cylinder 331, an L-shaped connecting plate 332, a first pushing rod 333, a second pushing rod 334, a guide rail 336, and a sliding seat 335. The handle pushing cylinder 331 and the guide rail 336 are disposed in a row on the mounting platform 32. The sliding seat 335 corresponds to the guide rail 336. The L-shaped connecting plate 332 is fixed on the sliding seat 335, and the L-shaped connecting plate 332 is connected to a piston rod of the handle pushing cylinder 331. The first pushing rod 333 and the second pushing rod 334 are detachably mounted on the L-shaped connecting plate 332, and front ends of the first pushing rod 333 and the second pushing rod 334 are arc-shaped to fit a handle. A gap between the first pushing rod 333 and the second pushing rod 334 is adjustable, so as to adapt to different types of brush handles.

Figure 10:
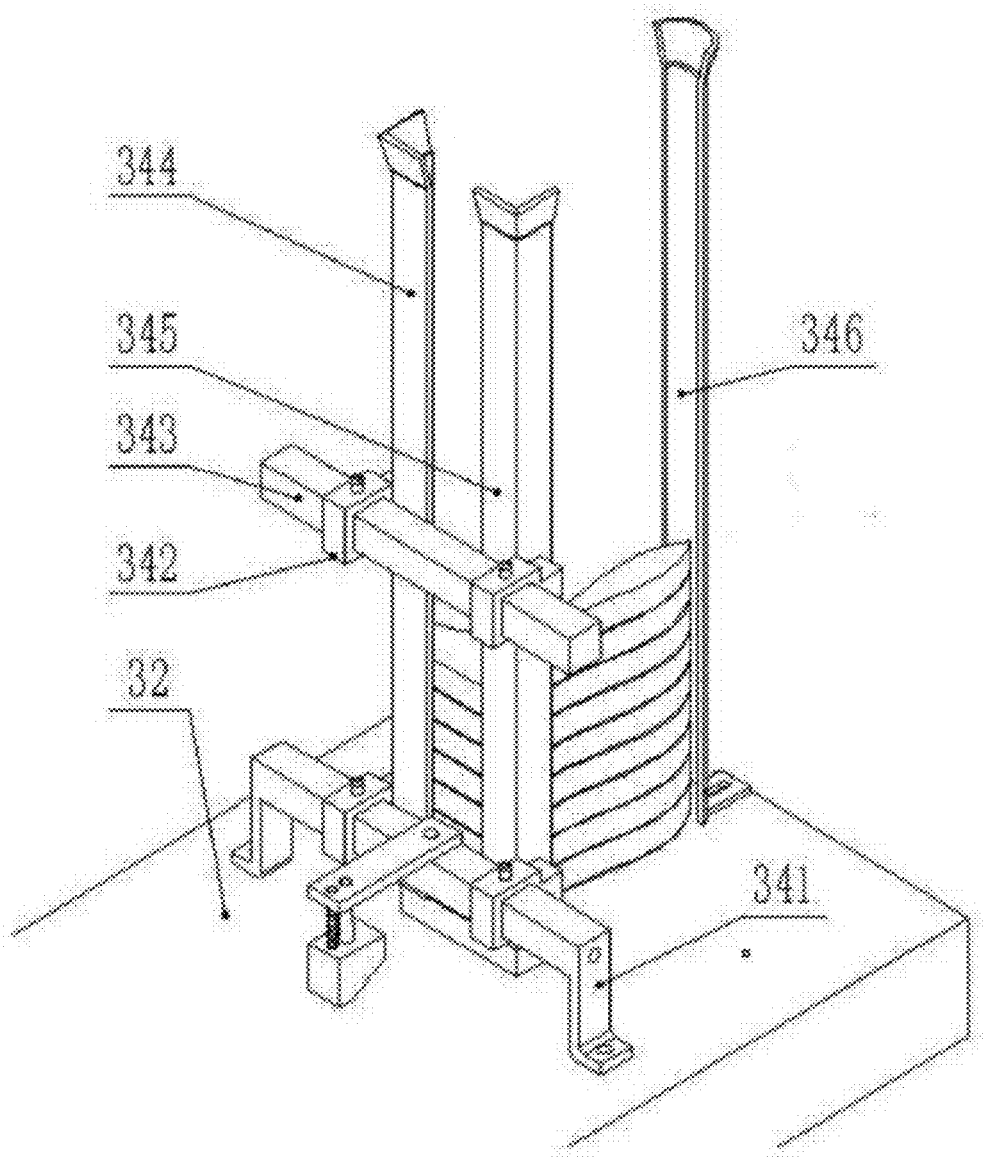
FIG. 10 is a schematic structural diagram of a handle storage mechanism according to the present invention.

As shown in FIG. 10, the handle storage mechanism 34 includes a mounting frame 341, a cross rod 343, a left material storage tank 344, a right material storage tank 345, and a rear material storage tank 346. The mounting frame 341 is fixed on the mounting platform 32. The rear material storage tank 346 is detachably disposed on the mounting platform 32. Two sliding blocks 342 are respectively fixedly connected to the left material storage tank 344 and the right material storage tank 345. The sliding blocks 342 at lower ends of the left material storage tank 344 and the right material storage tank 345 are sleeved on the mounting frame 341. The cross rod 343 passes through the sliding blocks 342 in the middle of the left material storage tank 344 and the right material storage tank 345. A gap between the left material storage tank 344 and the right material storage tank 345 is adjusted and the position of the rear material storage tank 346 is changed to adapt to storage of different types of brush handles.

Figure 11:
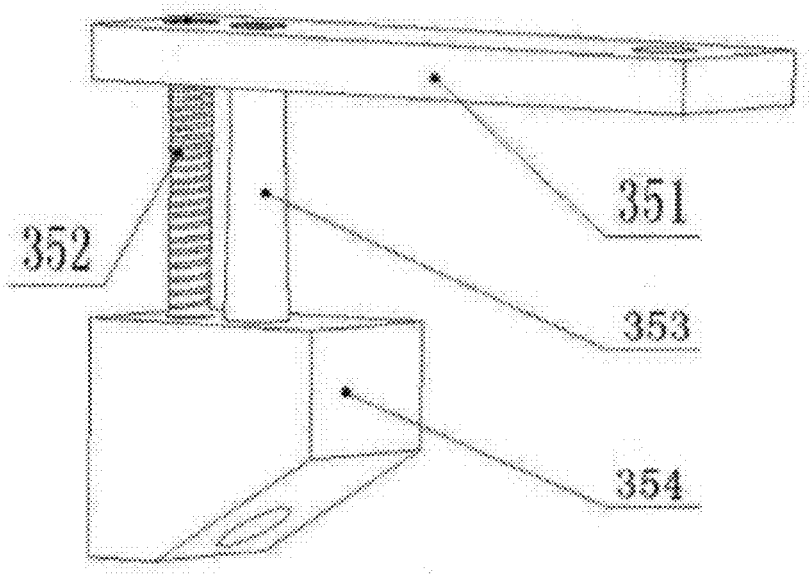
FIG. 11 is a schematic structural diagram of a handle pressing mechanism according to the present invention.

As shown in FIG. 11, the handle pressing mechanism 35 includes a connecting beam 351, a telescopic guiding rod 352, a pressing block 354, and a tapered rod 353. One end of the connecting beam 351 is fixed in the middle of the mounting frame 341. The pressing block 354 is disposed at a bottom of the other end of the connecting beam 351 through the telescopic guiding rod 352 and the tapered rod 353. A reset spring is sleeved on the telescopic guiding rod 352.

Figure 12:
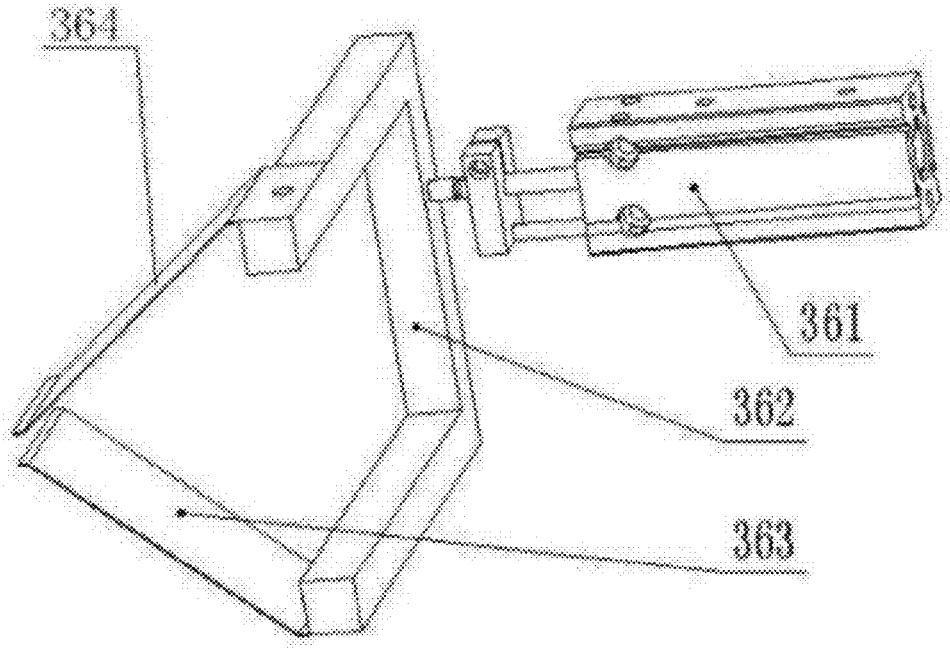
FIG. 12 is a schematic structural diagram of a shell supporting mechanism according to the present invention.

As shown in FIG. 12, the shell supporting mechanism 36 includes a shell supporting cylinder 361, a U-shaped connecting frame 362, an upper spring sheet 364, and a lower spring sheet 363. The shell supporting cylinder 361 is disposed on the mounting platform 32. An opening of the U-shaped connecting frame 362 faces rightward, and a middle thereof is connected to a piston rod of the shell supporting cylinder 361. The upper spring sheet 364 and the lower spring sheet 363 are respectively fixed on an upper lateral edge and a lower lateral edge of the U-shaped connecting frame 362. An angle is formed between free ends of the upper spring sheet 364 and the lower spring sheet 363, and a top end of the angle is aligned with the handle assembly station.

In this embodiment, a pneumatic system is further included. The feeding device 1, the conveying device 2, and the handle pushing device 3 are all connected to the pneumatic system.

Figure 13:
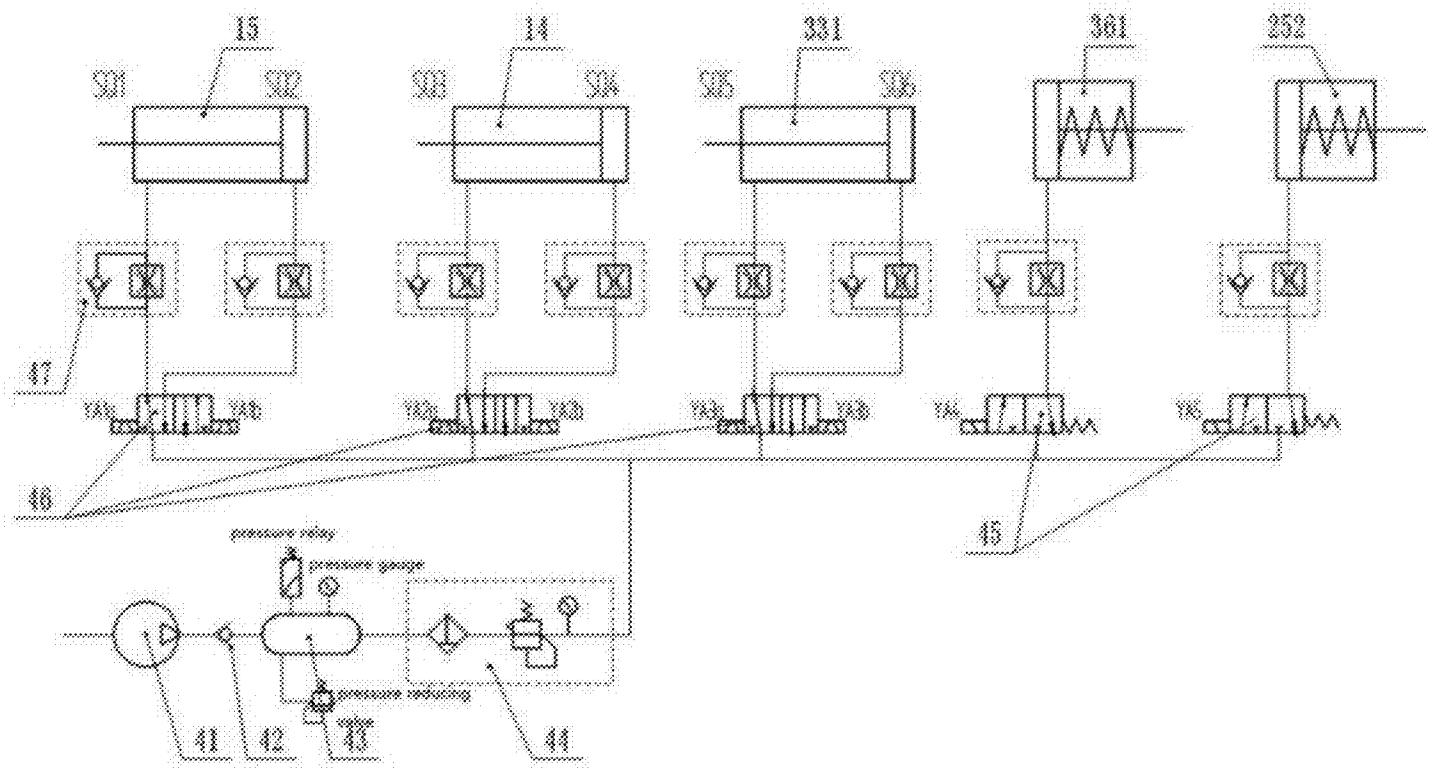
FIG. 13 is a principle diagram of a pneumatic system according to the present invention.

As shown in FIG. 13, the pneumatic system includes an air compressor 41, a check valve 42, a gas storage tank 43, a secondary pressure-regulation loop 44, a two-position three-way solenoid valve 45, a two-position five-way solenoid directional valve 46, and an adjustable one-way throttle valve 47. The air compressor 41, the check valve 42, the gas storage tank 43, and the secondary pressure-regulation loop 44 are sequentially connected to form a main gas path. A pressure relay, a pressure reduction valve, and a pressure gauge are disposed on the gas storage tank 43. A gas outlet of the secondary pressure-regulation loop 44 is connected to five branches, and the five branches are respectively connected to the elevation cylinder 15, the transversely-moving cylinder 14, the handle pushing cylinder 331, the shell supporting cylinder 361, and the pressing cylinder 252. The elevation cylinder 15, the transversely-moving cylinder 14, and the handle pushing cylinder 331 are respectively connected to the secondary pressure-regulation loop 44 through the two-position five-way solenoid directional valve 46 and the adjustable one-way throttle valve 47. The shell supporting cylinder 361 and the pressing cylinder 252 are respectively connected to the secondary pressure-regulation loop 44 through the two-position three-way solenoid valve 45 and the adjustable one-way throttle valve 47.

Figure 14:
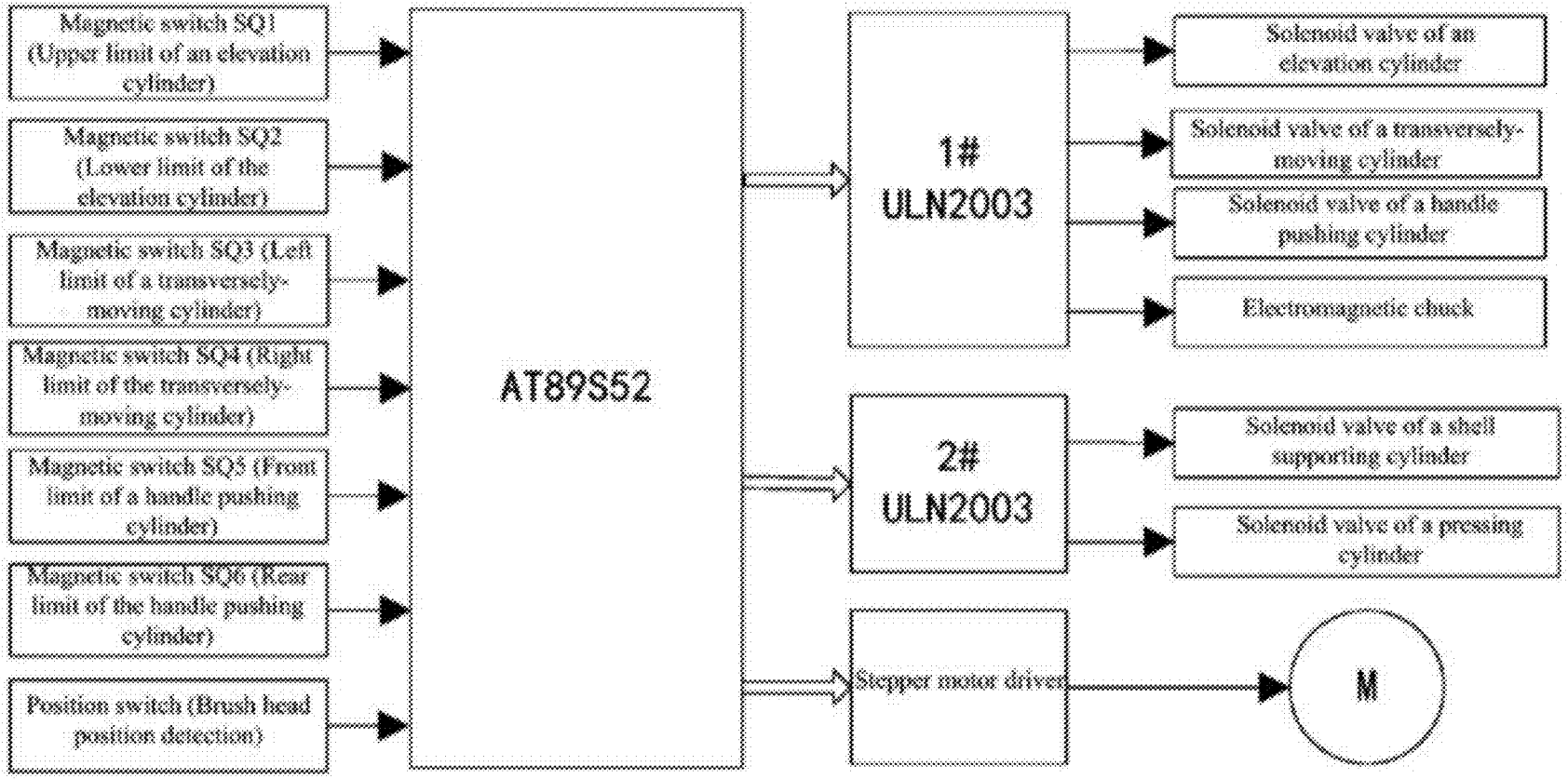
FIG. 14 is a principle diagram of a control system according to the present invention.

In this embodiment, a control system is further included. The feeding device 1, the conveying device 2, the handle pushing device 3, and the pneumatic system are all connected to the control system;

As shown in FIG. 14, the control system includes a controller, a ULN2003 chip, and a stepper motor driver, and the controller uses an AT89S52 single-chip microcomputer. Magnetic switches are disposed on the elevation cylinder 15, the transversely-moving cylinder 14, and the handle pushing cylinder 331. A position switch is disposed at the handle assembly station on the conveying platform 22. The magnetic switches and the position switch are connected to a signal input terminal of the AT89S52 single-chip microcomputer. A signal output terminal of the AT89S52 single-chip microcomputer is connected to the two-position five-way solenoid directional valve 46, the two-position three-way solenoid valve 45, and the electromagnetic chuck 16 through the ULN2003 chip. The signal output terminal of the AT89S52 single-chip microcomputer is connected to the rotary motor 261-1 through the stepper motor driver.

A specific implementation manner of the present invention is as follows:

The glue-filled paint brush head is attracted by the electromagnetic chuck 16, and moves to the entrance of the conveying device 2 under the effect of the elevation cylinder 15 and the transversely-moving cylinder 14. The brush head is guided by the brush head guiding mechanism 23 and is then pushed by the pushing claw 263 to the brush head pre-pressing mechanism 24 and the pressing-positioning mechanism 25. The pressing cylinder 252 is pressed down to enable the lower plate 254 to tightly press the brush head to start handle assembly. Handles are stored in the handle storage mechanism 34. The gap between the left material storage tank 344 and the right material storage tank 345 is adjusted and the position of the rear material storage tank 346 is changed to adapt to storage of different types of handles. A handle at a bottom layer of the handle storage mechanism 34 is pushed by the first pushing rod 333 and the second pushing rod 334 and is inserted in the tightly pressed brush head. The shell supporting mechanism 36 can guide the handle and support an opening of an iron shell of the brush head before the handle is inserted in the brush head. After handle assembly is completed, the pressing cylinder 252 resets, and the brush head assembled with the handle is pushed by the pushing claw 263 to a next step.

In such process, the pneumatic forces of the cylinders are generated and controlled by the pneumatic system. The air compressor 41 compresses air. An output air pressure of the compressed air is adjusted by passing through the gas storage tank 43 and the secondary pressure-regulation loop 44. Then, the air is introduced into the cylinders via the solenoid valves, and the adjustable one-way throttle valve 47 adjusts the operation speeds of the cylinders. The solenoid valves, the electromagnetic chuck 16, and the rotary motor 261-1 are controlled by the control system. The magnetic switches on the elevation cylinder 15, the transversely-moving cylinder 14, and the handle pushing cylinder 331 detect whether the cylinders move to desired positions. The position switch at the handle assembly station detects whether the brush head moves to a desired position. The magnetic switches and the position switch transfer detection results to a signal input terminal of the controller. The controller (that is, the AT89S52 single-chip microcomputer) outputs an operation instruction according to a set program after receiving detection signals. Control signals output by the controller are amplified by the ULN2003 chip, and the amplified control signals are transferred to the two-position three-way solenoid valve 45, the two-position five-way solenoid directional valve 46, and the electromagnetic chuck 16. By controlling gains and losses of the two-position three-way solenoid valve 45, the two-position five-way solenoid directional valve 46, and the electromagnetic chuck 16, corresponding cylinders are controlled to complete movement. In addition, the controller uses the stepper motor driver to control rotational speed of the rotary motor 261-1.

The foregoing descriptions are only preferred implementation manners of the present invention. It should be noted that for a person of ordinary skill in the art, several improvements and modifications may further be made without departing from the principle of the present invention. These improvements and modifications should also be deemed as falling within the protection scope of the present invention.

What is claimed is:

1. An automatic handle assembly system for a paint brush, comprising a feeding device, a conveying device, and a handle pushing device, the feeding device being disposed on a right side of the conveying device, and the handle pushing device being disposed on a rear side of the conveying device;

wherein the feeding device is used for transporting a glue-filled paint brush head to an entrance of the conveying device;

the conveying device is used for realizing transportation, pressing and precise positioning of the paint brush head; and the handle pushing device is used for pushing a paint brush handle to precisely insert into the paint brush head, and completing the assembly of the paint brush handle;

the feeding device includes a base, a mounting plate, a guiding mechanism, a transversely-moving cylinder, an elevation cylinder, an electromagnetic chuck, and a threaded connecting piece, wherein the mounting plate is horizontally fixed on the base, the transversely-moving cylinder is disposed at the mounting plate; the guiding mechanism includes a first gantry, a second gantry, a guiding rod, a linear bearing, and a connecting piece, wherein the first gantry and the second gantry are fixed on the mounting plate, and the guiding rod is horizontally fixed on the first gantry and the second gantry; one end of the guiding rod passes through the first gantry to extend onto the second gantry, and the other end of the guiding rod extends above the entrance of the conveying device, the linear bearing is sleeved on the guiding rod, and the connecting piece and the linear bearing are integrally connected as one piece; the elevation cylinder is fixed at a bottom of the connecting piece, and a piston rod of the transversely-moving cylinder is connected to the connecting piece; and the electromagnetic chuck is disposed on a piston rod of the elevation cylinder through the threaded connecting piece.

2. The automatic handle assembly system for a paint brush according to claim 1, wherein the conveying device includes a machine frame, a conveying platform, a brush head guiding mechanism, a brush head pre-pressing mechanism, a pressing-positioning mechanism, and a linkage transport mechanism, wherein the conveying platform is strip-shaped and is horizontally fixed on the machine frame, and a right end of the conveying platform is the entrance; the linkage transport mechanism is disposed below the conveying platform, the brush head guiding mechanism, the brush head pre-pressing mechanism, and the pressing-positioning mechanism are sequentially disposed from right to left on the conveying platform, and a handle assembly station is located at the pressing-positioning mechanism on the conveying platform;

the linkage transport mechanism includes a transmission mechanism, two plane linkage mechanisms, a pushing claw, and a pushing claw mounting rod, the transmission mechanism includes a rotary motor, a coupling member, a belt pulley, and a supporting platform, the rotary motor and the belt pulley are disposed on the supporting platform; the belt pulley includes a driving shaft, a driving wheel, a driven shaft, a driven wheel, a conveyor belt, and an adjustment bolt, the driving wheel, the driven wheel, and the adjustment bolt are used to tension the conveyor belt; the rotary motor drives the driving shaft and the driving wheel to rotate via the coupling member, and further drives the driven wheel and the driven shaft to rotate via the conveyor belt;

the two plane linkage mechanisms are consistent in structure and size, the two plane linkage mechanisms include a first linkage mechanism and a second linkage mechanism, the first linkage mechanism includes a first crank, a first linkage, a first rocker, a first supporting rod, and a first fixing rod, and the second linkage mechanism includes a second crank, a second linkage, a second rocker, a second supporting rod, and a second fixing rod;

a head end of the first crank is hinged to the driving shaft, and the first crank and the driving shaft rotate synchronously; a tail end of the first crank is hinged to a head end of the first linkage, a tail end of the first linkage is hinged to a head end of the first rocker, a tail end of the first rocker is hinged to a free end of the first fixing rod; a head end of the second crank is hinged to the driven shaft, the second crank and the driven shaft rotate synchronously; the second crank and the first crank are consistent in initial position, connection relationship among the second crank, the second linkage, the second rocker, and the second fixing rod are consistent with connection relationship among the first crank, the first linkage, the first rocker, and the first fixing rod; the first fixing rod and the second fixing rod are both vertically fixed at a bottom of the conveying platform, and lower ends of the first supporting rod and the second supporting rod are respectively hinged to a middle of the first linkage and a middle of the second linkage;

the pushing claw mounting rod is horizontally disposed at upper ends of the first supporting rod and the second supporting rod, recesses with equal intervals are provided on the pushing claw mounting rod, the pushing claw is mounted in the recesses; the conveying platform is provided in a length direction with a long groove for the pushing claw to pass therethrough; the brush head guiding mechanism includes a first guiding plate and a second guiding plate, the first guiding plate and the second guiding plate are disposed opposite to each other on a front lateral edge and a rear lateral edge of the conveying platform, and a distance between the first guiding plate and the second guiding plate is adjustable;

the brush head pre-pressing mechanism includes a first mounting frame, an upper pressing plate, a lower pressing plate, and a first spring component, and the first mounting frame is disposed on the front lateral edge of the conveying platform; the upper pressing plate is horizontally fixed on the first mounting frame, and the lower pressing plate is disposed below the upper pressing plate through the first spring component; and the pressing-positioning mechanism includes a second mounting frame, a pressing cylinder, an upper plate, a lower plate, and a second spring component, and the second mounting frame is disposed on the front lateral edge of the conveying platform; the upper plate is horizontally fixed on the second mounting frame, the lower plate is disposed below the upper plate through the second spring component; the pressing cylinder is fixed on the second mounting frame, and a compressing block is disposed on a piston rod of the pressing cylinder; an opening for the compressing block to pass therethrough is provided on the upper plate, and the compressing block is used to press down the lower plate.

3. The automatic handle assembly system for a paint brush according to claim 2, wherein the handle pushing device includes a bracket, a mounting platform, a handle pushing mechanism, a handle storage mechanism, a handle pressing mechanism, and a shell supporting mechanism;

the mounting platform is horizontally fixed on the bracket; the handle pushing mechanism, the handle storage mechanism, and the shell supporting mechanism are sequentially disposed from rear to front on the mounting platform, and the handle pressing mechanism is disposed on the handle storage mechanism;

the handle pushing mechanism includes a handle pushing cylinder, an L-shaped connecting plate, a first pushing rod, a second pushing rod, a guide rail, and a sliding seat, the handle pushing cylinder and the guide rail are both disposed on the mounting platform; the sliding seat corresponds to the guide rail, the L-shaped connecting plate is fixed on the sliding seat, and the L-shaped connecting plate is connected to a piston rod of the handle pushing cylinder; the first pushing rod and the second pushing rod are detachably mounted on the L-shaped connecting plate, and front ends of the first pushing rod and the second pushing rod are arc-shaped to fit a handle;

the handle storage mechanism includes a mounting frame, a cross rod, a left material storage tank, a right material storage tank, and a rear material storage tank, the mounting frame is fixed on the mounting platform, and the rear material storage tank is detachably disposed on the mounting platform; sliding blocks are both fixedly connected to the left material storage tank and the right material storage tank, the sliding blocks at lower ends of the left material storage tank and the right material storage tank are sleeved on the mounting frame, and the cross rod passes through the sliding blocks in the middle of the left material storage tank and the right material storage tank;

the handle pressing mechanism includes a connecting beam, a telescopic guiding rod, a pressing block, and a tapered rod, one end of the connecting beam is fixed in the middle of the mounting frame, the pressing block is disposed at a bottom of the other end of the connecting beam through the telescopic guiding rod and the tapered rod, and a reset spring is sleeved on the telescopic guiding rod; and the shell supporting mechanism includes a shell supporting cylinder, a U-shaped connecting frame, an upper spring sheet, and a lower spring sheet, the shell supporting cylinder is disposed on the mounting platform; an opening of the U-shaped connecting frame faces rightward, and a middle thereof is connected to a piston rod of the shell supporting cylinder; the upper spring sheet and the lower spring sheet are respectively fixed on an upper lateral edge and a lower lateral edge of the U-shaped connecting frame, an angle is formed between free ends of the upper spring sheet and the lower spring sheet, and a top end of the angle is aligned with the handle assembly station.

4. The automatic handle assembly system for a paint brush according to claim 3, further comprising a pneumatic system, wherein the feeding device, the conveying device and the handle pushing device are all connected to the pneumatic system; and the pneumatic system includes an air compressor, a check valve, a gas storage tank, a secondary pressure-regulation loop, a two-position three-way solenoid valve, a two-position five-way solenoid directional valve, and an adjustable one-way throttle valve; the air compressor, the check valve, the gas storage tank, and the secondary pressure-regulation loop are sequentially connected to form a main gas path, and a pressure relay, a pressure reduction valve, and a pressure gauge are disposed on the gas storage tank; a gas outlet of the secondary pressure-regulation loop is connected to five branches, and the five branches are respectively connected to the elevation cylinder, the transversely-moving cylinder, the handle pushing cylinder, the shell supporting cylinder, and the pressing cylinder; the elevation cylinder, the transversely-moving cylinder, and the handle pushing cylinder are respectively connected to the secondary pressure-regulation loop through the two-position five-way solenoid directional valve and the adjustable one-way throttle valve, and the shell supporting cylinder and the pressing cylinder are respectively connected to the secondary pressure-regulation loop through the two-position three-way solenoid valve and the adjustable one-way throttle valve.

5. The automatic handle assembly system for a paint brush according to claim 4, further comprising a control system, wherein the feeding device, the conveying device, the handle pushing device, and the pneumatic system are all connected to the control system; and the control system comprises a controller, a ULN2003 chip, and a stepper motor driver, the controller uses an AT89S52 single-chip microcomputer; magnetic switches are disposed on the elevation cylinder, the transversely-moving cylinder, and the handle pushing cylinder, a position switch is disposed at the handle assembly station on the conveying platform, and the magnetic switches and the position switch are connected to a signal input terminal of the AT89S52 single-chip microcomputer; a signal output terminal of the AT89S52 single-chip microcomputer is connected to the two-position five-way solenoid directional valve, the two-position three-way solenoid valve, and the electromagnetic chuck through the ULN2003 chip, and the signal output terminal of the AT89S52 single-chip microcomputer is further connected to the rotary motor through the stepper motor driver.

6. The automatic handle assembly system for a paint brush according to claim 3, wherein a gap between the first pushing rod and the second pushing rod is adjustable.

7. The automatic handle assembly system for a paint brush according to claim 2, wherein a groove matching a shape of a brush head is disposed at a bottom of the lower plate, and a notch is provided at the handle assembly station on the conveying platform.

* * * * *